US005987947A

United States Patent [19]

Shen

[11] Patent Number: 5,987,947

[45] Date of Patent: Nov. 23, 1999

[54] MANUAL CONTROL DEVICE FOR A PICKPROOF LOCK ASSEMBLY

[76] Inventor: Mu-Lin Shen, No. 32, Lane 76, Sec. 5, Fuan Rd., Tainan, Taiwan

[21] Appl. No.: 09/232,717

[22] Filed: Jan. 19, 1999

[51] Int. Cl.[6] ..... E05B 13/10

[52] U.S. Cl. ..... 70/467; 70/216; 70/224; 70/386; 70/473; 70/476; 70/483

[58] Field of Search ..... 70/215, 216, 224, 70/386, 467, 470, 471, 473–483

[56] References Cited

U.S. PATENT DOCUMENTS

| | | | |
|---|---|---|---|
| 841,209 | 1/1907 | Wykoff | 70/478 X |
| 1,395,414 | 11/1921 | Huffman | 70/475 X |
| 2,293,856 | 8/1942 | Schlage | 70/480 |
| 2,966,054 | 12/1960 | Muttart | 70/216 |
| 2,998,274 | 8/1961 | Russell | 70/467 X |
| 3,111,021 | 11/1963 | Patriquin et al. | 70/476 X |
| 3,125,876 | 3/1964 | Kuchler | 70/216 |
| 3,321,942 | 5/1967 | Russell et al. | 70/479 |
| 3,955,387 | 5/1976 | Best et al. | 70/224 |
| 4,594,864 | 6/1986 | Hart | 70/143 |
| 5,177,987 | 1/1993 | Shen | 70/224 |

*Primary Examiner*—Lloyd A. Gall
*Attorney, Agent, or Firm*—Rosenberg, Klein & Lee

[57] ABSTRACT

A manual control device includes an actuated tube which is connected to the stem member contacting against the rod movably received in the plug of the pickproof lock, an operating member securely connected to the actuating tube by receiving the boss thereof in the groove defined in the actuating tube, wherein the operating member has a rib so as to be frictionally received in the actuating tube. Both of the actuating tube and the operating member are received in the sleeve which has an L-shaped groove into which the protrusion extending from the actuating tube is movably received. The stem member pushes the rod of the pickproof lock by pushing the combination of the actuating tube and the operation member and rotating the combination to let the protrusion be securely positioned in the L-shaped groove of the sleeve.

3 Claims, 4 Drawing Sheets

MANUAL CONTROL DEVICE FOR A PICKPROOF LOCK ASSEMBLY

FIELD OF THE INVENTION

The present invention relates to a manual control device, and more particularly, to the engagement of the operating member and the actuating tube which is frictionally and rotatably retained in the L-shaped groove defined in the inside spindle so as to operate the locking means in the pickproof lock as disclosed in U.S. Pat. No. 5,177,987.

BACKGROUND OF THE INVENTION

A pickproof lock is disclosed in U.S. Pat. No. 5,177,987 to Schlage and includes a rod movably received in the plug, wherein the rod has a notch and the plug and the housing respectively have a passage and a smaller passage which are located in alignment with each other. The ball is movably received in the notch, the passage and the smaller passage. When the rod is moved by pushing the operating member in the inside knob, the ball is therefore pushed by the periphery defining the notch and pressed to move toward the smaller passage and straddles the shear line of the plug and the housing so that even if the correct key is inserted into the keyway of the lock, the plug is not rotated. The shifting of the rod to its initial position to let the ball be removed from the shear line between the plug and the housing can only be achieved by a special tool which belongs to the authorized persons. With this lock, some places such as hotels, room guests who are not welcomed will be prohibited from re-entering rooms even if they have keys.

In order to prevent the operating member in the inside knob from being operated unintentionally, the inventor of the present invention discloses the engagement of the operating member and the actuating tube wherein the operating member has to be operated by a tool and moved along the L-shaped groove in the sleeve in which the actuating tube and the operating member are received so that the operating member will not be operated unintentionally. Furthermore, in order to securely retain the operating member in the actuating tube, a rib extends radially outward from the operating member so as to frictionally engage with the actuating tube.

SUMMARY OF THE INVENTION

In accordance with one aspect of the present invention, there is provided a manual control device for a pickproof lock, wherein the pickproof lock includes a rod movably received in the cylinder plug with a notch defined in the rod and a ball movably received in the notch and the two passages respectively defined in the cylinder plug and the cylinder housing, the device comprising an actuating tube having a first end with a protrusion extending radially outward therefrom and a groove defined longitudinally in the outside of the actuating tube so as to define a shoulder portion near the first end of the actuating tube. An operating member has an open first end mounted to the second end of the actuating tube and a boss extends radially inward from the first end so as to be received in the groove of the actuating tube. The operating member further has a rib extending radially outward therefrom so as to frictionally engage with the actuating tube. A sleeve has an L-shaped groove defined through the peripheral wall thereof and receives the combination of the operating member and the actuating tube. The protrusion is movably retained in the L-shaped groove. A stem member has the first end thereof connected to the first end of the actuating tube and the second end thereof extending through the sleeve so as to push the rod in the cylinder plug by operating the operating member.

The object of the present invention is to provide manual control of the pickproof lock wherein the operating member has a rib extending radially outward therefrom so as to frictionally engage with the actuating tube.

Another object of the present invention is to provide manual control of the pickproof lock wherein the operating member is operated by pushing it toward the outside knob and rotating it to be securely positioned.

Further objects, advantages, and features of the present invention will become apparent from the following detailed description with appropriate reference to the accompanying drawings.

DETAILED DESCRIPTION OF THE PREFERRED EMBODIMENT

Figure 5:
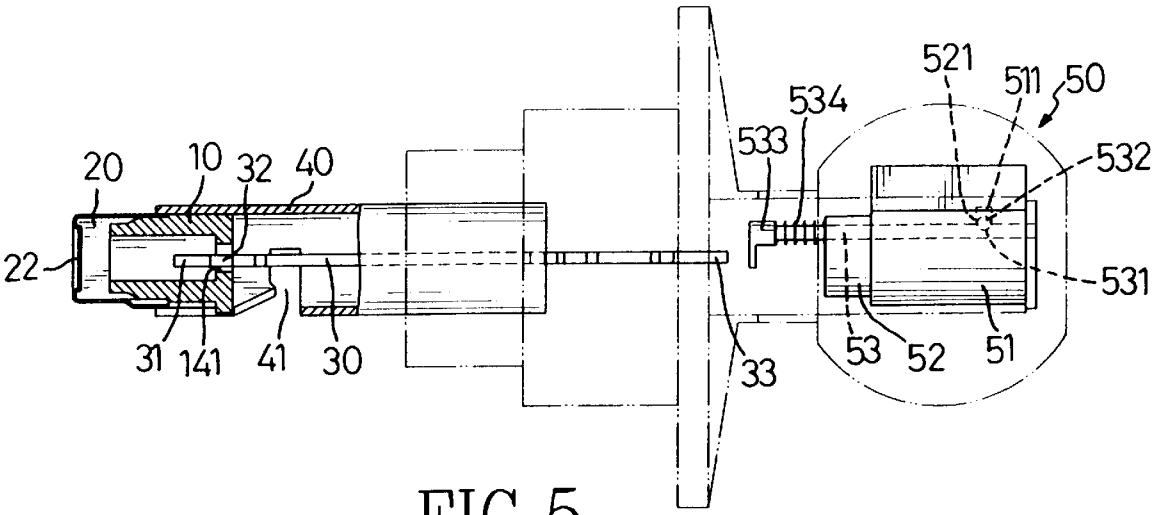
FIG. 5 is an illustrative view seen from another side of the arrangement as shown in FIG. 4.
Figure 4:
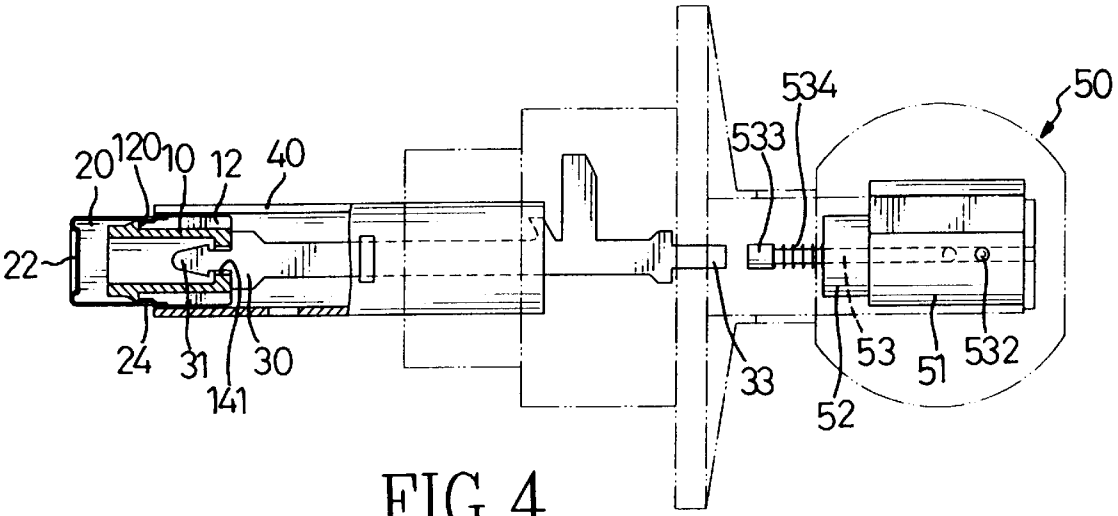
FIG. 4 is an illustrative view to show the arrangement of the manual control device and the pickproof lock.
Figure 6:
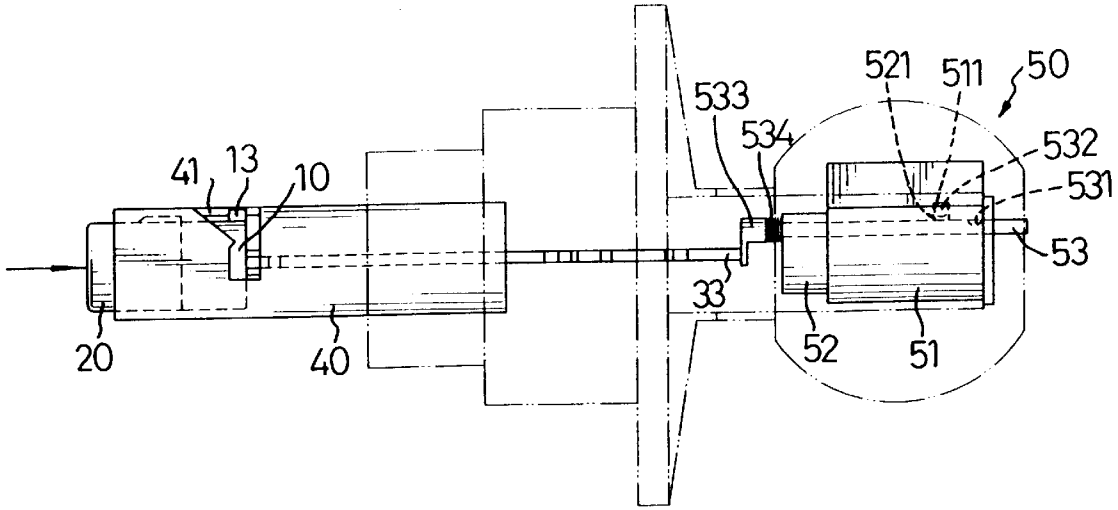
FIG. 6 is an illustrative view to show the arrangement of the manual control device and the pickproof lock, wherein the operating member is pushed.
Figure 7:
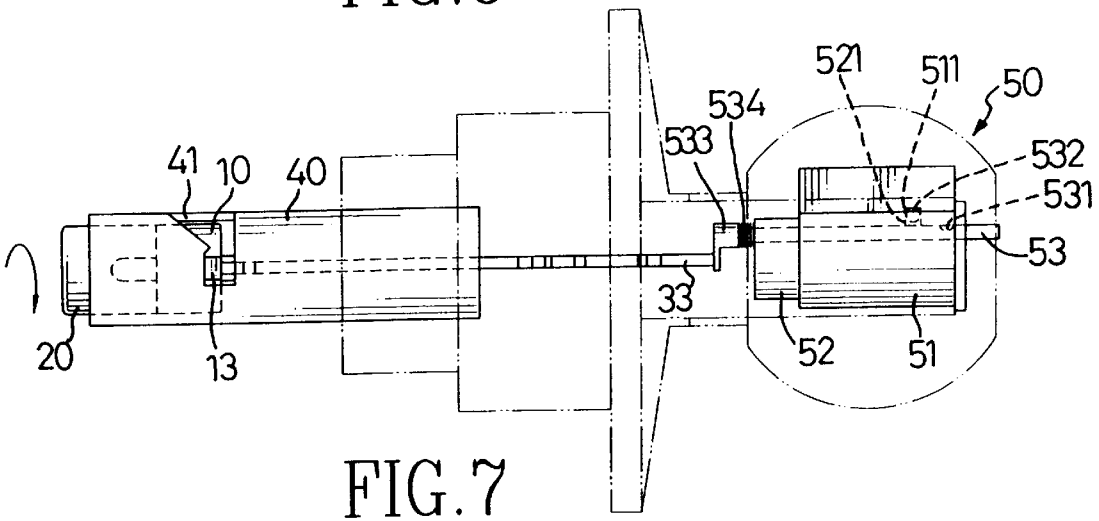
FIG. 7 is an illustrative view to show the arrangement of the manual control device and the pickproof lock, wherein the operating member is rotated.

Referring to FIGS. 4 and 5, a pickproof lock has a rod (53) movably received in the cylinder plug (52) which is rotatable in the cylinder housing (51), both the cylinder plug (52) and the cylinder housing (51) are received in the outside knob (50). The rod (53) has a notch (531) defined in the outside thereof, and the cylinder plug (52) and the cylinder housing (51) respectively has a passage (521, 511) defined radially therethrough and located in alignment with each other when the lock is in the locked position. A ball (532) is movably received in the notch (531) and the two passages (521, 511) so that when the lock is in a normal locked position, the ball (532) is partly received in the notch (531) and partly received in the passage (521) in the cylinder plug (52), and the cylinder plug (52) can be rotated relative to the cylinder housing (51) by inserting a key (not shown) in the key hole defined in the cylinder plug (52). When the rod (53) is pushed as shown in FIGS. 6 and 7, the ball (532) is pushed by the bottom of the notch (531) in the rod (53) and straddles the shear line between the cylinder plug (52) and the cylinder housing (51) so that the cylinder plug (52) cannot be rotatable relative to the cylinder housing (51). Such a pickproof lock is disclosed in U.S. Pat. No. 5,177,987 to Schlage.

Figure 1:
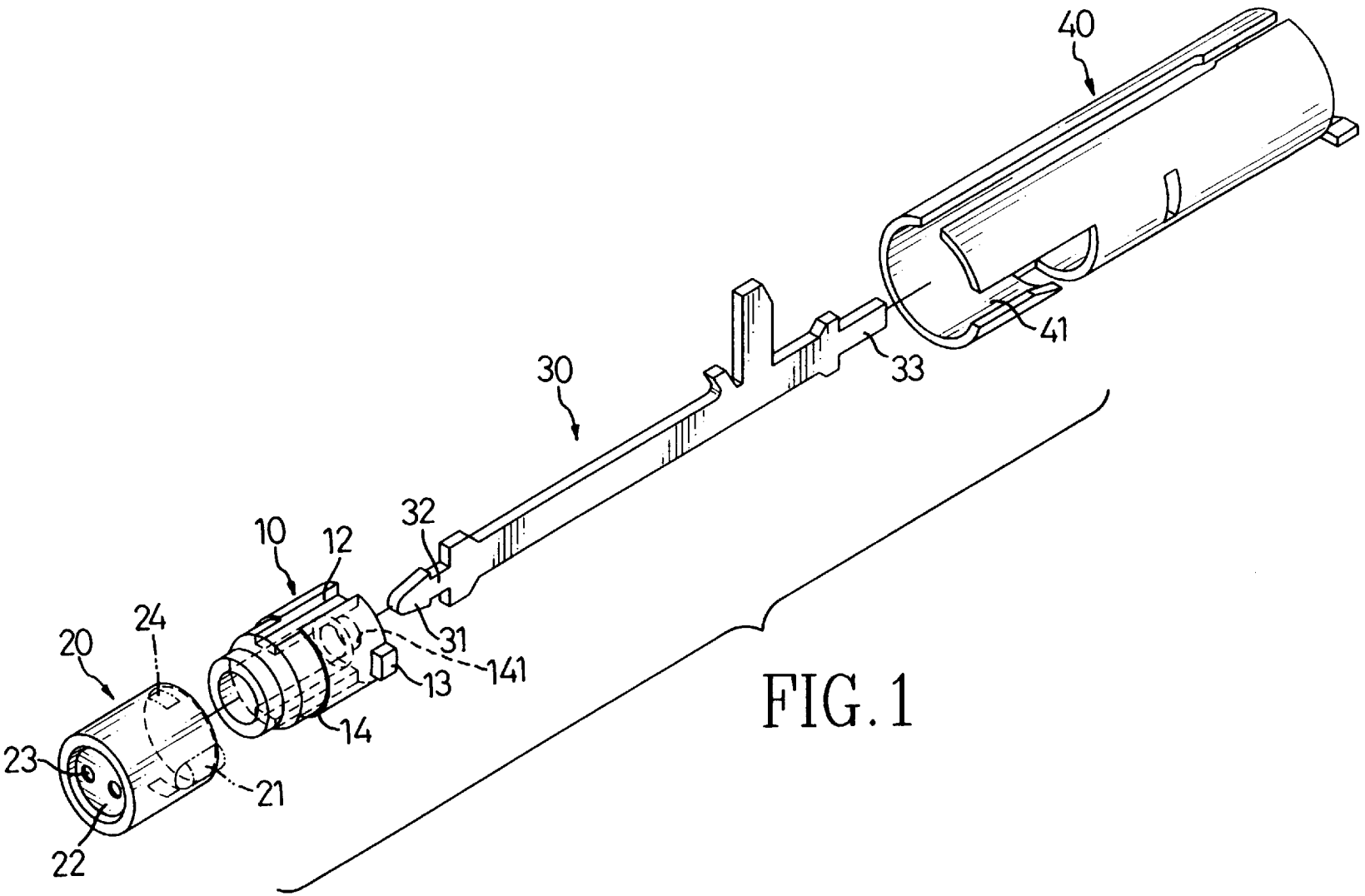
FIG. 1 is an exploded view of the manual control device in accordance with the present invention.
Figure 3:
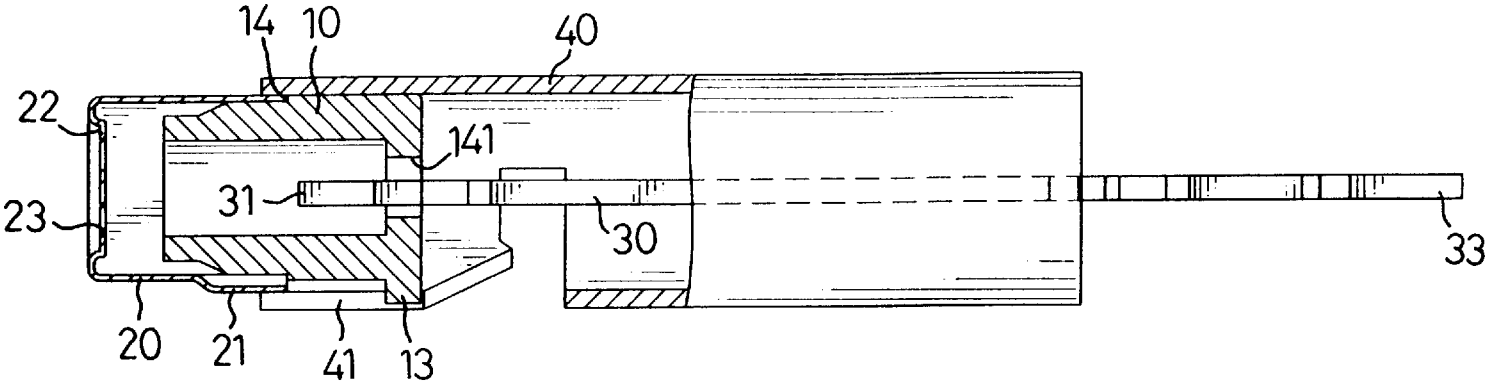
FIG. 3 is a top elevational view partly in section, of the manual control device as shown in FIG. 2.
Figure 2:
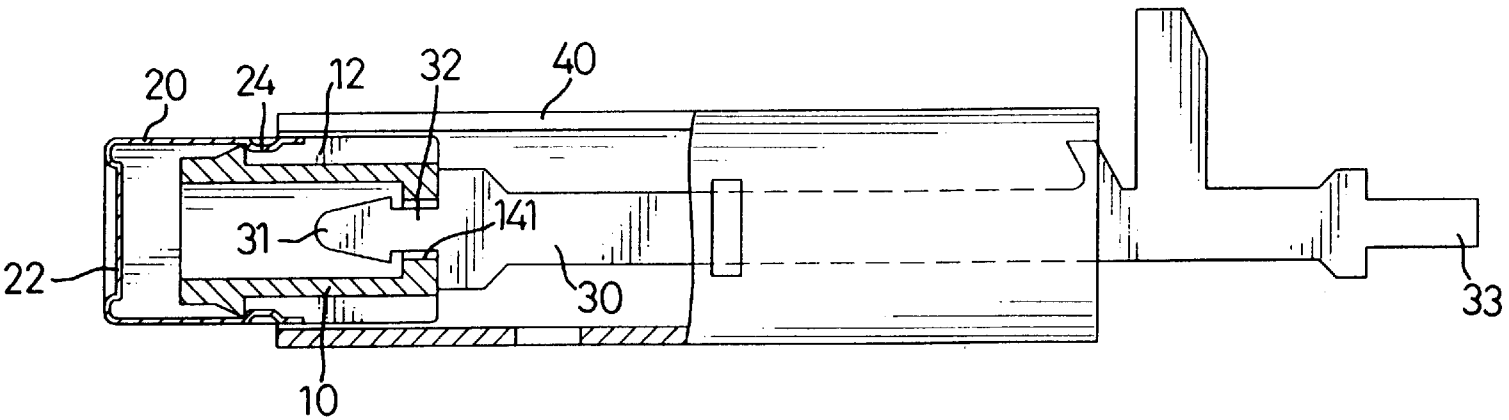
FIG. 2 is a side elevational view, partly in section, of the manual control device in accordance with the present invention.

Referring to FIGS. 1 to 3, the manual control device in accordance with the present invention comprises an actuating tube (10) having a first end with a protrusion (13) extending radially outward therefrom and a groove (12)

defined longitudinally in the outside of the actuating tube (10) so as to define a shoulder portion (120) near the first end of the actuating tube (10). An outer shoulder (14) is defined in the outside of the actuating tube (10). An operating member (20) has an open first end securely mounted to the second end of the actuating tube (10) with the first end of the operating member (20) contacting against the outside shoulder (14) and a boss (24) extends radially inward from the first end so as to be received in the groove (12) of the actuating member (10) and engaged with the shoulder portion (120). A rib (21) extends radially outward from the first end of the operating member (20). The second end of the operating member (20) has a board (22) and the board (22) has two apertures (23) defined therethrough so that the operating member (20) can be rotated by using a tool (not shown) inserted into the two apertures (23).

A sleeve (40) has an L-shaped groove (41) defined through the peripheral wall thereof and receives the combination of the operating member (20) and the actuating tube (10). The protrusion (13) is movably retained in the L-shaped groove (41) and the rib (21) is frictionally engaged with the sleeve (40).

A stem member (30) has the first end (31) thereof force-fit into the first end of the actuating tube (10) and the second end (33) of the stem member (30) extends through the sleeve (40) so as to contact the head portion (533) of the rod (53) wherein a spring (534) is mounted to the rod (53) and located between the head portion (533) and the cylinder plug (52). A narrow neck portion (32) is defined in the first end (31) of the stem member (30), and the first end of the actuating tube (10) has an annular flange (141) extending radially inward therefrom so that the neck portion (32) is engaged with the annular flange (141).

Accordingly, when actuating the manual control device of the present invention, the operator pushes the operating member (20) to move the protrusion (13) along the longitudinal portion of the L-shaped groove (41) and then rotates the operating member (20) by the tool engaged with the two apertures (23) to receive the protrusion (13) in the transverse portion of the groove (41). When the operating member (20) is pushed, the rod (53) is pushed to press the ball (532) to straddle the shear line between the cylinder plug (52) and the cylinder housing (51). When the operating member (20) is rotated, the operating member (20) is securely positioned by receiving the protrusion (13) in the transverse portion of the groove (41). The operating member (20) will not be actuated unintentionally simply by pushing the operation member (20) toward the outside knob (50) because the return force of the spring (534) will push the protrusion (13) along the longitudinal portion of the groove (41) and the combination of the actuating tube (10) and the operating member (20) then return to their initial position. The rib (21) of the operating member (20) is frictionally engaged with the inside of the actuating tube (40) so that the operating member (20) will not easily be disengaged from the actuating tube (40).

Although the invention has been explained in relation to its preferred embodiment, it is to be understood that many other possible modifications and variations can be made without departing from the spirit and scope of the invention as hereinafter claimed.

What is claimed is:

1. A manual control device for a pickproof lock which has a rod movably received in a cylinder plug with a notch defined in the rod, a ball movably received in the notch and two passages respectively defined in the cylinder plug and a cylinder housing, said device comprising:

an actuating tube having a first end and a second end, said first end thereof having a protrusion extending radially outward therefrom and a groove defined longitudinally in the outside of said actuating tube so as to define a shoulder portion near said first end of said actuating tube;

an operating member having an open first end mounted to said second end of said actuating tube and a boss extending radially inward from the first end so as to be received in the groove of said actuating tube, a rib extending radially outward from the first end of said operation member so as to be frictionally engaged with a sleeve;

the sleeve having an L-shaped groove defined through the peripheral wall thereof and receiving the combination of said operating member and said actuating tube, said protrusion movably retained in said L-shaped groove, and a stem member having the first end thereof connected to said first end of said actuating tube and the second end of said stem member extending through said sleeve so as to be adapted to contact said rod in said cylinder plug.

2. The device as claimed in claim 1, wherein the second end of said operating member has a board which has two apertures defined therethrough.

3. The device as claimed in claim 1 further comprising a narrowed neck portion defined in said first end of said stem member and said first end of said actuating tube having an annular flange extending radially inward therefrom so that said neck portion is engaged with said annular flange.

* * * * *